United States Patent [19]

Ogman

[11] 4,350,497

[45] Sep. 21, 1982

[54] REINFORCED GRINDING DEVICE

[76] Inventor: Abraham Ogman, Nine Downing Rd., Peabody, Mass. 01960

[21] Appl. No.: 185,347

[22] Filed: Sep. 8, 1980

[51] Int. Cl.[3] ..... B24D 3/00

[52] U.S. Cl. ..... 51/296; 51/206 NF; 51/209 R; 51/298

[58] Field of Search ..... 51/206 NF, 209 R, 296, 51/298; 106/40 R; 501/39

[56] References Cited

U.S. PATENT DOCUMENTS

| | | | |
|---|---|---|---|
| 2,986,455 | 5/1961 | Sandmeyer | 51/296 |
| 3,252,775 | 5/1966 | Tocci-Guilbert | 51/296 |
| 3,716,950 | 2/1973 | McClure | 51/206 NF |
| 3,828,485 | 8/1974 | McClure | 51/206 NF |
| 3,867,795 | 2/1975 | Howard | 51/206 NF |
| 3,918,220 | 11/1975 | Jury et al. | 51/296 |
| 3,939,612 | 2/1976 | Peterson | 51/206 NF |

FOREIGN PATENT DOCUMENTS

| | | |
|---|---|---|
| 951450 | 3/1964 | United Kingdom . |
| 1199404 | 7/1970 | United Kingdom . |

*Primary Examiner*—Donald E. Czaja
*Assistant Examiner*—W. Thompson
*Attorney, Agent, or Firm*—Abraham Ogman

[57] ABSTRACT

An abrasive device is defined by a honeycomb or cellular structure which is configured to define the grinding device. The cells of the cellular structure are filled with the normal constituents that make up a grinding wheel such as abrasive grains, a bonding matrix such as an organic resin, and fillers. The bonding matrix acts to bond the abrasive grains together into a uniform mass. The bonding medium is also designed to bond the abrasive and fillers to the walls of the cellular structure.

6 Claims, 3 Drawing Figures

REINFORCED GRINDING DEVICE

BACKGROUND OF THE INVENTION

In existing grinding wheel structures, metal rings are sometimes embedded within the interior of the grinding wheel in order to reinforce the structure. More commonly, discs formed from a layer of glass fabric are positioned at or near the sides of the grinding wheel. Occasionally, one or more discs are embedded within the grinding wheel. These discs are bonded to the grinding wheel structure by means of the bonding medium holding the abrasive grains together.

In these existing structures the reinforcement operates in discrete planes coincident with the planes in which the reinforcement disc lies. There is no reinforcement between planes. In short such prior art reinforcing means are two-dimensional. Strength laterally to the reinforcing planes still depends on the strength of the bonding medium and fillers.

It is an object of the invention to provide a three-dimensional reinforcing means for abrasive devices.

It is another object of the invention to provide a reinforcing means throughout the grinding device.

It is yet another object of the invention to provide a reinforcing means which will tend to more evenly distribute stresses within a grinding device.

It is still another object of the invention to provide a reinforcing means which will prevent catastrophic propagation of cracks developing within a grinding device.

It is still another object of the invention to provide a grinding device, including reinforcing means, which avoids the limitations and disadvantages of such prior devices.

In accordance with the invention, a grinding device comprises a cellular or honeycomb structure having walls defining open cells. The cellular structure is configured to define the shape of the grinding device. A blend of abrasives and a bonding medium are deposited within the cells. Appropriate fillers may be used. The bonding medium is fully cured to hold the abrasive grains and fillers together into an abrasive mass. The abrasive mass is bonded to the walls defining the cells to produce a unitary grinding device.

The novel features that are considered characteristic of the invention are set forth in the appended claims; the invention itself, however, both as to its organization and method of operation, together with additional objects and advantages thereof, will best be understood from the following description of a specific embodiment when read in conjunction with the accompanying drawings, in which:

DESCRIPTION OF THE INVENTION

Figure 1:
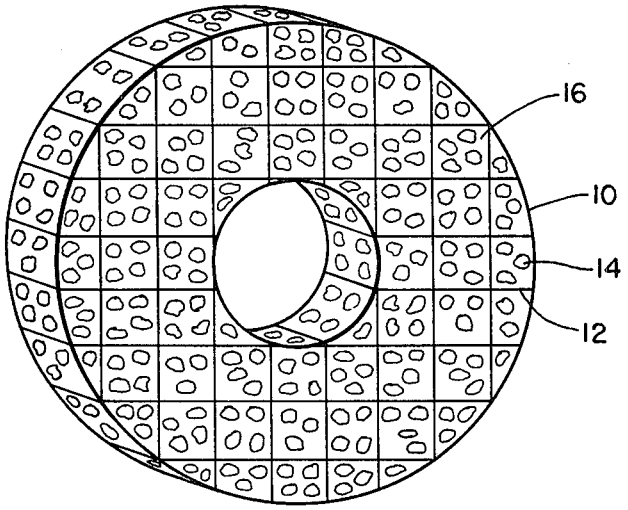
FIG. 1 is a pictorial representation of a reinforced grinding wheel embodying the principals of the present invention.

FIG. 1 is a pictorial representation of a grinding wheel 10 embodying the principals of the present invention. The grinding wheel 10 includes a cellular or honeycomb structure, defined by the walls 12, which is configured to define the shape of the grinding wheel. There is deposited in each and every cell a blend of abrasive grains 14 in combination with a bonding medium 16. The bonding medium 16 acts to bond the abrasive grains 14 together and to the walls 12 defining the cells so that a unitary grinding wheel is constructed.

The invention does not depend on the type of grain material used, the size of the abrasive grains, or the type of bonding medium used. The most common type of grinding wheel used in the industry is called a resinoid grinding wheel which generally comprises abrasive grains and filler bonded together by an organic resin matrix. Phenolic and epoxy resin systems are widespread. Metal matrices have also been used in certain instances.

The preferred material for the cellular structure is fiberglass, as the glass is frangible and tends to dissipate harmlessly during the grinding procedure. Preferably, the walls 12 of the cellular structure are precoated with the bonding medium that is to be used to hold the abrasive grains together so as to form a compatible bonding system throughout.

Figure 2:
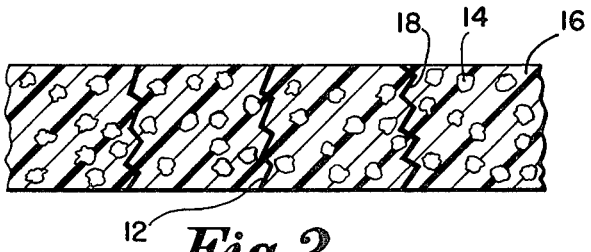
FIG. 2 is a partial cross section depicting one type of cellular wall structure.

An alternative cellular wall structure is cases where it will not interfere with the grinding action is made from a ductal material such as aluminum. The advantage that aluminum has over fiberglass is that it may be deformed under compression to form lateral projections 18 shown in FIG. 2. The lateral projections tend to increase the bond surface of the walls 12 and also tend to mechanically lock the blend deposited within the cells to the cellular structure.

Conventionally, grinding wheels, such as shown in FIG. 1, are made by depositing a blend of abrasive grain filler and dry bonding medium within a mold. The blend is compressed to form a so-called green compact which is self-supporting. The green compact is then placed within a kiln and fired to cure the resin medium thereby forming the grinding wheel.

Figure 3:
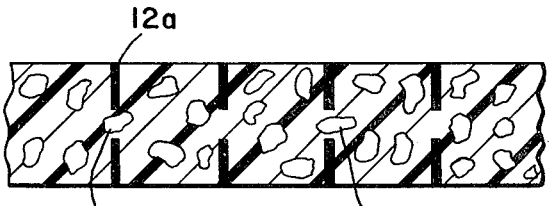
FIG. 3 is a partial cross section depicting another form of the cellular wall structure.

The invention may be practiced without materially altering the aforementioned manufacturing procedure. In the act of compressing the blend, an abrasive grain may penetrate through a wall structure. This effect is not seen as being detrimental. In fact, in FIG. 3, an alternative wall structure shows the walls **12*a* forming the cellular structure having predefined therein passages 20. The passages 20 will permit the blend in adjacent cells to be in direct communication, such as shown at 22**. The joining of the abrasive-bond blend in adjacent cells forms a network of mechanically interlocking junctions which will tend to discourage the isolated dislodging of the abrasive and bonding material from an individual cell.

The principal advantage of this invention, as visualized, is the provision of three-dimensional reinforcements. In addition, the interconnected cellular wall structure will tend to equalize stresses throughout the body of the grinding device by distributing stress throughout the wall structure.

In conventional prior art devices, cracks initiated anywhere within the grinding wheel tend to propagate rapidly leading to a premature catastrophic bursting of the wheel. The walls of the cells will prevent cracks developing within a particular cell from propagating beyond the confines of the cell, thus preventing or minimizing any crack propagation.

The net result is to provide a very strong wheel which is capable of being rotated at higher speeds than conventional prior art wheels.

The cellular wall structure may be used to provide a reinforced core in grinding wheels using a core and rim. The concept may be extended to having stones or other abrasive devices.

The various features and advantages of the invention are thought to be clear from the foregoing description. Various other features and advantages not specifically enumerated will undoubtedly occur to those versed in the art, as likewise will many variations and modifications of the preferred embodiment illustrated, all of which may be achieved without departing from the spirit and scope of the invention as defined by the following claims.

I claim:

1. A reinforced grinding device comprising:

a honeycomb structure having walls defining open cells, said honeycomb structure being configured to define the shape of the grinding device; and a blend of abrasive grains secured within a bond matrix deposited in said cells, said cells of the honeycomb structure being filled completely with said blend of abrasive grains and bond matrix to produce a solid unitary structure.

2. A grinding device as defined in claim 1 wherein the walls are precoated with a material compatible with the bond.

3. A grinding device as defined in claim 1 wherein the walls are pierced and the blend in adjacent cells is in direct communication.

4. A grinding device as defined in claim 1 wherein the walls contain lateral projections to mechanically anchor the blend within a cell.

5. A reinforced grinding device as defined in claim 1 wherein the walls are precoated with a material compatible with the blend, the walls are pierced so that the blend in adjacent cells is in direct communication, and wherein the walls contain lateral projections to mechanically anchor the blend within a cell.

6. A reinforced grinding device as defined in claim 1 wherein the honeycomb structure is formed from a frangible material.

* * * * *